United States Patent [19]

Maid et al.

[11] Patent Number: 4,790,889

[45] Date of Patent: Dec. 13, 1988

[54] HOT-ROLLED STRIP HAVING A DUAL-PHASE STRUCTURE

[75] Inventors: Olaf Maid, Dinslaken; Lutz Meyer, Voerde; Antonio Massip, Duisburg; Wolfgang Müschenborn, Dinslaken, all of Fed. Rep. of Germany

[73] Assignee: Thyssen Stahl AG, Duisburg, Fed. Rep. of Germany

[21] Appl. No.: 51,892

[22] Filed: May 19, 1987

Related U.S. Application Data

[62] Division of Ser. No. 793,075, Oct. 31, 1985, abandoned.

[30] Foreign Application Priority Data

Nov. 8, 1984 [DE] Fed. Rep. of Germany ..... 3440752

[51] Int. Cl.[4] ..... C22C 38/10

[52] U.S. Cl. ..... 148/333; 420/104

[58] Field of Search ..... 420/104; 148/333, 12 F

[56] References Cited

U.S. PATENT DOCUMENTS 4,421,573 12/1983 Irie et al. ..... 148/12 F

FOREIGN PATENT DOCUMENTS 58-93814 6/1983 Japan ..... 148/333

*Primary Examiner*—Deborah Yee

*Attorney, Agent, or Firm*—Sprung Horn Kramer & Woods

[57] ABSTRACT

The invention relates to a method of producing hot-rolled strip having a dual-phase structure from a slab previously produced by ingot casting or continuous casting. The slab contains carbon, manganese, silicon and chromium as essential constituents in addition to iron. The slab is heated up to the rolling temperature, hot-rolled at a temperature above $A_{r3}$, rapidly cooled from the rolling temperature and coiled at a relative low temperature. The characterizing features of the invention are that the hot-rolled strip (a) is produced from a steel which, in addition to 0.05 to 0.16% of C, 0.5 to 1.0% of Si, 0.3 to 1.5% of Cr, ≦0.025% of P, ≦0.015% of S, 0.02 to 0.10% of Al and ≦0.011% of N, contains 0.2 to 0.4% of Mn, the remainder being iron and usual impurities, (b) is rapidly cooled, immediately after finish-rolling, from final rolling temperature down to the coiling temperature at a mean rate in the range from 30° to 70° C./s and without interruptions, and (c) is then coiled at a temperature in the range from 350° to 190° C.

10 Claims, No Drawings

HOT-ROLLED STRIP HAVING A DUAL-PHASE STRUCTURE

This is a division of application Ser. No. 793,075, filed Oct. 31, 1985, now abandoned.

BACKGROUND OF THE INVENTION

A method of producing hot-rolled strip having a dual-phase structure composed of fine-grained ferrite (>70%) and martensite grains dispersed therein, wherein the slab essentially containing carbon, manganese, silicon and chromium is first heated to the hot-rolling temperature, then hot-rolled and finish-rolled above $A_{r3}$, subsequently cooled rapidly and finally coiled at a low temperature, has been disclosed by European Pat. No. 19,193 and European patent application No. 72,867.

In the method disclosed by European Pat. No. 19,193, the slab containing essentially 0.05–0.20% of C, 0.5–1.5% of Mn and 0.5–2.0% of Si as well as, if appropriate, Cr, V, Mo, Ti and Nb, the remainder being iron, is hot-rolled in the austenitic state, then cooled down to a temperature in the range from about 800° to 650° C., coiled and held for at least one minute at this temperature. Subsequently, the strip is unwound in a further process step, cooled at a rate of >10° C./second to a temperature of <450° C. and finally coiled again at this temperature.

In the method disclosed by European patent application No. 72,867, the slab which has been heated to the rolling temperature and which essentially contains 0.02–0.20% of C, 0.5–2.0% of Mn, 0.05–2.0% of Si and 0.3–1.5% of Cr as well as ≦0.15% of P and ≦0.1% of Al, the remainder being iron, is hot-rolled at a final rolling temperature >780° C. After leaving the finishing step, the hot-rolled strip is cooled to an intermediate temperature $T_N$ of the order of about 750°–650° C. at a rate of >40° C./second and held for at least 5 seconds at this temperature. Subsequently, further rapid cooling at a rate of 50° C./second to a temperature in the range from 550° to 200° C. takes place, before the strip is finally coiled at this temperature.

In both the prior methods, a low ratio of the yield point to the tensile strength (<about 0.70) and a good cold formability of the hot-rolled strip, or of the sheet produced from it, are obtained. However, in order to establish the appropriate dual-phase structure, a controlled or stepped cooling process is envisaged in both cases after the hot-rolling or finish-rolling of the hot-rolled strip. Phases of rapid cooling and phases of holding the hot-rolled strip at a defined temperature (cooling in stagnant air) alternate. With respect to equipment, both cooling methods entail expensive cooling sections or, in the case of the prior method of European Pat, No. 19,193, a second uncoiling and coiling device for the finish-rolled hot-rolled strip.

On the other hand, European patent application No. 68,598 has disclosed a method of producing hot-rolled strip having a dual-phase structure, a low ratio of the yield point to the tensile strength and good formability, wherein, as distinct from the two abovementioned methods, the hot-rolled strip, after finish-rolling, is cooled to a low coiling temperature without additional provisions. Essentially, this is achieved by the slab having an increased phosphorus content in the range from 0.04 to 0.20%, in addition to containing 0.03–0.15% of C, 0.6–1.8% of Mn, ≦0.10% of Al, ≦0.008% of S and, if appropriate, 0.2–2.0% of Si alone or together with Cr, the remainder being iron. In addition, the slab must be heated to a defined temperature in the predetermined range from 1,100 to 1,250° C., before it is then hot-rolled and, at a temperature in the range from 900° to 780° C., finish-rolled and, after finish-rolling, cooled at a rate in the range from 10° to 200° C./second and finally can be coiled at a temperature of ≦450° C. Admittedly, this prior method has the advantage that the hot-rolled strip can be produced on conventional mill trains with the associated cooling section without additional expenditure on equipment. On the other hand, however, the increase in the phosphorus content entails a deterioration in the weldability of the hot-rolled strip. Furthermore, the tendency of the hot-rolled strip to temper embrittlement increases with rising or increased phosphorus content. This temper embrittlement especially manifests itself adversely whenever the sheet produced from the hot-rolled strip of increased phosphorus content must then, for example, be welded during further processing. Furthermore, the temperature of the furnace for heating the slab up to the rolling temperature and heating it through and through must be exactly set in this prior method, and in addition this temperature, out of the predetermined temperature range, is below the conventional temperatures.

It is thus the object of the invention to provide a method of producing hot-rolled strip having a dual-phase structure, which strip, coupled with an at least equally good property pattern, namely a low ratio of the yield point to the tensile strength (below about 0.70), isotropic cold workability and good weldability, can be produced by simple means especially on conventional mill trains with an associated cooling section, that is to say without additional expenditure on equipment.

SUMMARY OF THE INVENTION

According to the invention, this object is achieved by a method of producing hot-rolled strip having a dual-phase structure from a slab previously produced by ingot casting or continuous casting. The slab contains carbon, manganese, silicon and chromium as essential constituents in addition to iron. The slab is heated up to the rolling temperature, hot-rolled at a temperature above $A_{r3}$, rapidly cooled from the rolling temperature and coiled at a relatively low temperature. The characterizing features of the invention are that the hot-rolled strip (a) is produced from a steel which, in addition to 0.05 to 0.16% of C, 0.5 to 1.0% of Si, 0.3 to 1.5% of Cr, ≦0.025% of P, ≦0.015% of S, 0.02 to 0.10% of Al and ≦0.011% of N, contains 0.2 to 0.4% of Mn, the remainder being iron and usual impurities, (b) is rapidly cooled, immediately after finish-rolling, from final rolling temperature down to the coiling temperature at a mean rate in the range from 30° to 70° C./second and without interruptions, and (c) is then coiled at a temperature in the range from 350° to 190° C.

By comparison with the abovementioned already known state of the art, it is essential to the invention that the manganese content of the steel, from which first the slab and then the hot-rolled strip are produced, is reduced and adjusted to a low value in the range from 0.20 to 0.40%. Preferably, the carbon content of the steel is adjusted at the same time such that it has a value in the range from 0.05 to 0.12%.

The slab produced from a steel of the composition according to the invention can then, by the method according to the invention, be heated to the conventional rolling temperature and heated through and through. No special measures are required for this purpose.

According to the invention, the hot-rolling and finish rolling of the slab, which has been heated through and through, to give the hot-rolled strip takes places at a temperature which is above and as close as possible to $A_{r3}$. Furthermore, even with respect to this deformation during hot-rolling and, in particular, during finish-rolling in the last two stands of the finishing step, no further special measures are necessary when the method according to the invention is used. Thus, the deformation in the last two stands of the finishing step is 25% per stand as a maximum and is preferably of the order of 15%.

Subsequently, the hot-rolled strip is, according to the invention, rapidly cooled directly after finish-rolling from the final temperature above $A_{r3}$ down to the coiling temperature at a mean rate in the range from 30° to 70° C./second and without interruptions and then coiled at a temperature in the range from 350° to 190° C.

According to the invention, the slab additionally contains titanium the range of from 0.01 to 0.04% and in a stoichiometric ratio to the nitrogen, in order to obtain an improvement in the cold workability at the coiling temperature which according to the invention is low. At the same time, this avoids nitrogen-aging of the finish-rolled hot-rolled strip or of the sheet produced from it.

The essential advantage of the method according to the invention is that hot-rolled strip having a dual-phase structure composed of fine-grained, globular ferrite (>80%) and martensite grains dispersed therein can be produced on conventional hot-rolling strip mills with the associated downstream cooling section. The method according to the invention also makes it possible to omit known measures for accelerating the formation of ferrite and adverse effects thereof, such as, for example, a high end deformation on hot-rolling and finish-rolling in the two-phase region. A high end deformation here means undesirable high rolling forces and a deterioration in the levelness and geometry of the strip, and finish-rolling in the two-phase area likewise means high rolling forces, and deterioration in cold workability and anisotropic mechanical properties of the finish-rolled hot-rolled strip.

By comparison with the two prior methods disclosed by European Pat. No. 19,193 and European patent application No. 72,867, equipment changes and supplementary devices in the cooling section are not necessary. Furthermore, compared with the method disclosed by European patent application No. 68,598, it is also unnecessary to control the starting temperature of the hot-rolling and to set it exactly beforehand. Rather, the hot-rolling can be started even at a temperature of >1,250° C. in the method according to the invention.

In spite of the remark in European patent application No. 68,598, page 7, to the effect that an Mn content of at least 0.6% is necessary in order to establish the dual-phase structure, it has surprisingly been found that, according to the invention, this is also possible with a reduced Mn content, preferably in the range from 0.2 to 0.4%. It is to be regarded as a further advantage of the method according to the invention that the production costs are reduced due to the lower Mn content. Furthermore, the low Mn content according to the invention has the advantageous effect that virtually no prolate sulfides (MnS) are formed which usually cause a deterioration in cold workability, particularly in the transverse direction, in high-strength steels. For this reason, it is possible in the method according to the invention to dispense, for example, with lowering of the sulfur content during the production of the steel, in order to control the formation of prolate sulfides at higher Mn contents in this way. However, this means a reduction in the production costs of the hot-rolled strip produced by the method according to the invention.

Furthermore the method according to the invention in contrast to the method known from European patent application No. 68,598 has the advantage that an increased addition of phosphorus which would lead to embrittlement is not necessary.

Overall, it is possible by means of the method according to the invention to produce hot-rolled strip having a dual-phase structure composed of >80% of fine-grained, globular ferrite and martensite and having a ratio of the yield point to the tensile strength of <0.70, which strip can be welded without problems and has good uniform cold workability in both the longitudinal and transverse directions.

A further advantage of the method according to the invention is that, in the case of a hot-rolled strip produced by the method, an additional increase in the yield point is obtained after a deformation and subsequent temper treatment, for example by baking in an applied layer of a surface coating. Furthermore, the low alloy content permits the production of hot-rolled strip having a dual-phase structure with tensile strengths of 500 to 600 N/mm$^2$, which strip is especially suitable for the production of components which require high cold workability.

The invention is explained in more detail by reference to the illustrative examples which follow.

Continuously cast slabs having the chemical compositions A and B given in table 1 were first heated to a temperature of about 1,250° C. and heated through and through. Subsequently, at a temperature above $A_{r3}$, they were hot-rolled and finish-rolled to an end thickness d (see table 2). In doing this, the end-rolling or finish-rolling temperature was set as closely as possible to $A_{r3}$. The finish-rolled strips wer then rapidly cooled without interruptions at a mean rate in the range from 30° to 70° C./second on a conventional cooling section downstream of the hot-rolling train and wound up at the various coiling temperatures HT given in table 2. This resulted in the mechanical properties, summarized in table 2, of the finish-rolled sheets.

The values given in table 2 make is clear that it was possible to reach a ratio of the yield point to the tensile strength of <0.70 both in the longitudinal direction L and in the transverse direction Q in the strips or sheets produced by the method according to the invention. Table 2 also shows that a coiling temperature HT in the range from 350° to 190° C. must be adhered to according to the invention. By contrast, the desired ferritic/-martensitic structure is not reached at higher coiling temperatures, as can be seen from the upper yield point and the higher ratio of the yield point to the tensile strength (yield strength ratio) in the case of specimens A1 and B1.

Furthermore, table 2 shows that the coiling temperature HT should preferably be set to a temperature above 200° C. because, at a lower coiling temperature, see specimens A3 and B3, the ratio of the yield point to the tensile strength rises again and the elongation at break $A_5$ decreases to even poorer values. However, both these have an adverse effect on the cold workability of the hot-rolled strip or sheet.

Moreover, an aging treatment carried out by artificial means at 100° C. for about one hour did not cause any change in the yield point. On the other hand, for example in the case of the two strips or sheets A2 and B2, an increase in the yield point in the range from 40 to 80 $N/mm^2$ was found after a temper treatment at about 170° C. for 20 minutes, after the strips or sheets had first been subjected to a three percent pre-deformation.

TABLE 1

| Steel No. | C | Si | Mn | Cr | P | S | N | Al | Ti |
|---|---|---|---|---|---|---|---|---|---|
| A | 0.07 | 0.60 | 0.32 | 0.60 | 0.017 | 0.006 | 0.006 | 0.025 | 0.02 |
| | | | remainder iron and usual impurities. | | | | | | |
| B | 0.09 | 0.71 | 0.38 | 0.62 | 0.013 | 0.009 | 0.006 | 0.025 | 0.02 |
| | | | remainder iron and usual impurities. | | | | | | |

TABLE 2

| Steel No. | CT °C. | DM | d mm | $R_{p\,0,2}$ $N/mm^2$ | $R_{eH}$ $N/mm^2$ | $R_m$ $N/mm^2$ | $R_e/R_m$ | $A_5$ % |
|---|---|---|---|---|---|---|---|---|
| A1 | 400 | L | 3.8 | | 378 | 486 | 0.80 | 38.8 |
| | | Q | | | 401 | 484 | 0.85 | 37.2 |
| A2 | 280 | L | 3.8 | 330 | | 515 | 0.64 | 34.8 |
| | | Q | | 351 | | 514 | 0.68 | 36.9 |
| A3 | 200 | L | 4.0 | 385 | | 563 | 0.68 | 27.8 |
| | | Q | | 401 | | 581 | 0.69 | 26.8 |
| B1 | 420 | L | 3.3 | | 393 | 536 | 0.73 | 32.5 |
| | | Q | | | 391 | 541 | 0.72 | 30.5 |
| B2 | 330 | L | 3.3 | 338 | | 569 | 0.59 | 30.5 |
| | | Q | | 363 | | 577 | 0.63 | 31.0 |
| B3 | 200 | L | 3.1 | 368 | | 579 | 0.64 | 28.5 |
| | | Q | | 388 | | 570 | 0.68 | 26.4 |

$R_{p\,0,2}$: Substitute elongation limit
$R_{eH}$: Upper yield point
$R_m$: Tensile strength
$R_e/R_m$: Yield strength ratio
$A_5$: Elongation
L: Longitudinal
Q: Transverse
CT: Coiling temperature
DM: Direction of measuring

We claim:

1. A hot-rolled strip having a dual-phase structure and having a ratio of yield point to tensile strength of less than 0.70. derived from a slab previously produced by ingot casting or continuous casting and containing carbon, manganese, silicon and chromium as constituents in addition to iron, by heating the slab up to the rolling temperature, produced by hot-rolling and finish rolling at a temperature >Ar3, by rapid cooling from the rolling temperature and by coiling at a relatively low temperature, wherein the hot-rolled strip (a) is produced from a steel which, in addition to 0.05 to 0.16% of C, 0.5 to 1.0% of Si, 0.3 to 1.5% of Cr, ≦0.025% of P, ≦0.015% of S, 0.02 to 0.10% of Al and ≦0.011% of N, contains 0.2 to 0.4% of Mn, the remainder being iron and usual impurities, (b) is rapidly cooled, immediately after finish-rolling from the final rolling temperature down to the coiling temperature at a mean rate in the range from 30° to 70° C./second and without interruptions and (c) is then coiled at a temperature in the range from 330° to 190° C.

2. A hot-rolled strip as claimed in claim 1, wherein the carbon content of steel is 0.05 to 0.12%.

3. A hot-rolled strip as claimed in claim 1, wherein the phosphorus content of the steel is ≦0.0.15%.

4. A hot-rolled steel as claimed in claim 1, wherein 0.01 to 0.04% of Ti in a stoichiometric ratio to the nitrogen content present is additionally added to the steel.

5. A hot-rolled steel as claimed in claim 1, wherein the hot-rolled strip is finish-rolled at a temperature in the range from 20° to 50° C. above $A_{r3}$ and, after rapid cooling from the rolling temperature, is coiled at a temperature in the range from 330° to 260° C.

6. A hot rolled strip as claimed in claim 1, wherein the iron comprises globular ferrite and martensite grains dispersed therein.

7. A hot rolled strip as claimed in claim 1, wherein the iron comprises greater than 80% ferrite.

8. A hot rolled strip as claimed in claim 1, wherein said hot rolling is conducted at a temperature of above 1250° C.

9. A hot rolled strip as claimed in claim 1, wherein the starting temperature of the hot rolling is uncontrolled and not exactly set beforehand.

10. A hot rolled strip as claimed in claim 1, wherein the starting temperature of the hot rolling is greater than 1,250° C.

* * * * *